US007101119B2

(12) United States Patent
Cerda

(10) Patent No.: US 7,101,119 B2
(45) Date of Patent: Sep. 5, 2006

(54) SHORING ASSEMBLY AND METHOD

(76) Inventor: Victor M Cerda, 15207 Redwood Run Ct., Houston, TX (US) 77062

( * ) Notice: Subject to any disclaimer, the term of this patent is extended or adjusted under 35 U.S.C. 154(b) by 7 days.

(21) Appl. No.: 10/899,974

(22) Filed: Jul. 27, 2004

(65) Prior Publication Data

US 2006/0024137 A1 Feb. 2, 2006

(51) Int. Cl.
*E02D 17/04* (2006.01)

(52) U.S. Cl. ..... 405/282; 405/272

(58) Field of Classification Search ..... 405/272–274, 405/276, 282, 283
See application file for complete search history.

(56) References Cited

U.S. PATENT DOCUMENTS

| | | | | |
|---|---|---|---|---|
| 3,224,201 | A | 12/1965 | Brunton | |
| 3,230,720 | A * | 1/1966 | Bennett | 405/282 |
| 3,295,330 | A * | 1/1967 | Meshorer | 405/282 |
| 3,335,573 | A * | 8/1967 | Ward | 405/282 |
| 3,791,151 | A * | 2/1974 | Plank | 405/282 |
| 3,992,887 | A | 11/1976 | Fisher | |
| 4,056,940 | A | 11/1977 | Fisher | |
| 4,453,863 | A | 6/1984 | Sutton et al. | |
| 4,787,781 | A * | 11/1988 | Bradberry | 405/282 |
| 5,080,533 | A | 1/1992 | Cooper | |
| 5,096,334 | A | 3/1992 | Plank | |
| 5,209,606 | A | 5/1993 | Plank | |
| 5,232,313 | A * | 8/1993 | Jennings et al. | 405/283 |
| 5,290,129 | A | 3/1994 | Rody et al. | |
| 5,513,555 | A | 5/1996 | Plank et al. | |
| 5,868,060 | A | 2/1999 | Plank et al. | |
| 5,868,526 | A | 2/1999 | Caulder | |
| 6,224,296 | B1 | 5/2001 | Fukumori | |

OTHER PUBLICATIONS

Efficiency Production Incorporated, "Hydraulic Shoring"; brochure 12 pages; www.epi-shields.com.
Speed Shore Pioneering Trench Safety; "Vertical Shores"; brochure 4 pages; www.epi.sheilds.com.
Cerda Industries "Trench Shields Tough Durable Innovative Versatile" brochure 8 pages.
GME® "Steel Products Catalog" 12 pages.

* cited by examiner

*Primary Examiner*—Frederick L. Lagman
(74) *Attorney, Agent, or Firm*—Streets & Steele; Jeffrey L. Streets

(57) ABSTRACT

An inventive apparatus and method provides for restricting movement from a collapsed or folded position of a pair of rails employed by a shoring assembly. The shoring assembly has a plurality of first pads each pivotally connected to one of the rails, a plurality of second pads each pivotally connected to the other of the rails, and a plurality of hydraulic jacks each being operatively connected between an opposing pair of the first and second pads. The pivoting movement of the plurality of first pads is restricted relative to the one rail when the rails are disposed in the collapsed position. In a particular embodiment, a pair of first pads and a pair of second pads—respectively known as cylinder pads and socket pads—are employed by the shoring assembly. Accordingly, a pair of hydraulic jacks are further employed in this embodiment of the shoring assembly.

18 Claims, 9 Drawing Sheets

SHORING ASSEMBLY AND METHOD

BACKGROUND OF THE INVENTION

1. Field of the Invention

The present invention relates to shoring assemblies, such as vertical shoring assemblies, that support the sides of an excavation and which are designed to prevent cave-ins.

2. Background of the Related Art

It is common practice to shore or support the walls of an excavation (i.e., a trench) with one or more shoring systems. It is well known in the art of shoring to employ collapsible hydraulic shoring systems which are adapted for repeated use. FIG. 1 depicts a plurality of typical shoring systems 10, commonly known in the art as a vertical shores, used in parallel to support the walls W of an excavation. Each of the shoring systems includes a pair of aluminum rails (also known in the art as uprights) 12 suitable for abutting the walls W of the excavation and providing the support desired. The rails 12 are shown spaced apart by a pair of hydraulic jacks (also known in the art as crossbraces) 14 which are pivotally attached to the rails so as to permit the system 10 to be selectively collapsed and expanded by pivoting the jacks and folding rails 12 towards each other.

Such folding action permits shoring systems 10 to be placed within an excavation, and removed therefrom, without the need for an operator to be inside the excavation. As shown in FIG. 2A, the placement sequence includes connecting the system 10 to a portable pumping unit 16 via a hydraulic line 18, and lowering the connected system 10 into the excavation between walls W (left diagram) using ropes 22. The shoring system 10 is then permitted to unfold under its own weight (center diagram), and the pumping unit 16 is activated to achieve a suitable operating pressure in the hydraulic jacks 14 (typically, 750-1500 psig) thereby generating the support force provided through the rails 12 against the walls W (right diagram).

The removal sequence is generally depicted in FIG. 2B, and includes discharging the hydraulic fluid, which is biodegradable, from the system 10 to depressurize the jacks 14, and retracting the system 10 using ropes 22 to fold the rails 12 towards one another (left and center diagrams). The shoring system 10 is then carried away by the operator (right diagram).

The hydraulic jacks 14 are pivotally attached to the rails using force-transmitting pads (also called blocks), as shown in FIG. 3. More particularly, pads 24, commonly known as cylinder pads, are affixed to hydraulic cylinders 28 of hydraulic jacks 14 and are pivotally connected to cylinder rail 12*a* using pins 30*a*. Pads 26, commonly known as socket pads, are operatively connected to hydraulic rams or piston rods 32, via an oversleeve 35, and are pivotally connected to socket rail 12*b* using pins 30*b*. The hydraulic cylinders are fluidly interconnected by hydraulic line 40 and couplings 34, 36 secured in respective complementing ports (not numbered) of the cylinder pads 24. This interconnection permits both of the hydraulic jacks 14 to be pressurized and/or discharged through a single valve, such as a quick-connect valve 38.

A notable shortcoming in conventional shoring systems is the absence of a means for securing the rails 12 when folded together for transport. This creates a risk that the rails will separate (under the weight of the "lower" rail and the jack assembly) while being carried, resulting in uncontrolled dropping of the lower rail and pivoting of the hydraulic jacks 14. Such uncontrolled movement presents a hazard to the operator carrying the shoring assembly—particularly in the "pinch zones" 200 (see FIG. 3)—that may result in serious injury. A need therefore exists for restricting movement of the rails of a shoring assembly from the closed or folded position.

DEFINITIONS

Certain terms are defined throughout this description as they are first used, while certain other terms used in this description are defined below:

"Excavation" means any man-made cut, cavity, trench, or depression in an earth surface, formed by earth removal.

"Plurality" means two or more.

SUMMARY OF THE INVENTION

In one aspect, the present invention provides a shoring assembly, including a pair of rails, a plurality of first pads each having an end pivotally connected to one of the rails for pivotal movement between open and closed positions, a plurality of second pads each having an end pivotally connected to the other of the rails for pivotal movement between open and closed positions, and a plurality of hydraulic jacks each being operatively connected between an opposing pair of first and second pads. The first and second pads permit folding movement of the rails between an open position wherein the hydraulic jacks are substantially perpendicular to the rails and a closed position wherein the hydraulic jacks are oriented at one or more acute angles with respect to the rails. The shoring assembly further includes a latch assembly for restricting movement by the rails from the closed position.

In a particular embodiment of the inventive shoring assembly, the rails are adapted for vertical shoring applications. Alternatively, the rails may be adapted for horizontal shoring applications, in which case the rails are referred to in the art as walers.

Each of the hydraulic jacks preferably includes a hydraulic cylinder, a hydraulic piston disposed for axial movement within the hydraulic cylinder, and a piston rod for transferring force to or from the hydraulic piston. Accordingly, each of the first pads is adapted for operative connection to the hydraulic cylinder of one of the hydraulic jacks, and each of the second pads is adapted for operative connection to the hydraulic piston rod of the one hydraulic jack.

It is further preferred that the pivotally-connected end of each of the first pads is beveled to restrict pivoting of the first pads when the rails are folded to the closed position.

In a particular embodiment of the inventive shoring assembly, the one rail includes a plurality of first locking bores through a portion thereof, and the first pads are pivotally connected to the one rail at positions adjacent the respective first locking bores. In this embodiment, the first pads include respective second locking bores that are alignable with the respective first locking bores when the first pads are pivoted to positions at or near the closed positions. Accordingly, the latch assembly of this embodiment includes a pair of locking pins each sized and shaped for insertion into the first and second bores when aligned.

The locking pins are preferably releasably carried by the one rail. More particularly, the one rail preferably includes a plurality of carrying bores through a flanged portion thereof, and each of the locking pins includes a rod-like member having at least one ninety-degree bend (preferably two) therein defining parallel elongated and shortened linear portions. The elongated linear portion of the rod-like member is rotatably-carried in the carrying bores for selectively aligning and inserting the shortened linear portion into the first and second bores when aligned.

In a particular embodiment of the shoring assembly, the hydraulic jack further includes a wiper guide adapted to fit an open end of the hydraulic cylinder. The wiper guide has a central bore therein for receiving the piston rod and permitting sealed slidable movement of the piston rod therethrough. The jack further includes a bushing adapted to fit the central bore of the wiper guide so as to receive piston rods having smaller diameters.

In another aspect, the present invention provides a pad for use in a shoring assembly having a pair of rails each equipped with a pair of parallel flanges. The pad includes a body equipped with an upper face having a cylinder port therein for selectively energizing a hydraulic jack employed by the shoring assembly, a first transverse bore therein for pivotal connection to the flanges of one of the rails of the shoring assembly, and a second transverse bore therein for latching the body to the flanges of the one rail so as to restrict pivoting of the body relative to the one rail.

In a particular embodiment, the pad body is further equipped with a first flange having a pair of fluid entry ports therein, and a second flange having a pair of fluid exit ports therein. The fluid entry ports extend through a side wall of the first flange of the pad body and are oriented perpendicularly to the cylinder port. The fluid exit ports extending through an upper wall of the second flange of the pad body and are substantially-parallel to the cylinder port. The cylinder port is configured so as to be in fluid communication with the fluid entry ports and fluid exit ports. The second flange of the pad body has a beveled side wall for restricting pivoting of the body relative to the one rail.

In a still further aspect, the present invention provides a method of restricting movement from a collapsed position of a pair of rails employed by a shoring assembly. The shoring assembly has a plurality of first pads each pivotally connected to one of the rails, a plurality of second pads each pivotally connected to the other of the rails, and a plurality of hydraulic jacks each being operatively connected between an opposing pair of first and second pads. The method includes the step of restricting pivoting of the plurality of first pads relative to the one rail when the rails are disposed in the collapsed position.

In a particular embodiment of the inventive method, the restricting step includes using a locking pin releasably carried by the one rail.

BRIEF DESCRIPTION OF THE DRAWINGS

So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

Figure 4:
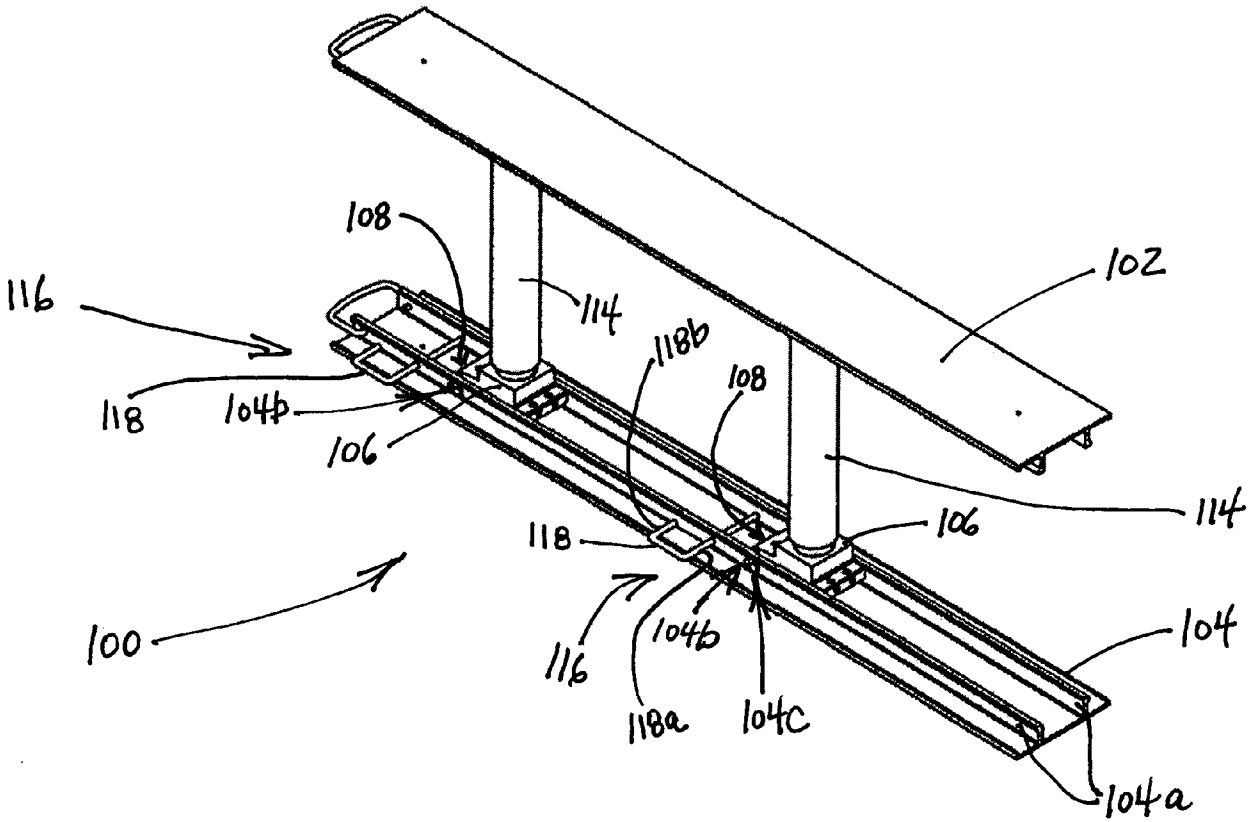
FIG. 4 is a perspective view of a shoring system in accordance with the present invention, shown in the fully unfolded position.

FIG. 4 illustrates one aspect of the present invention in the form of a shoring assembly 100. The shoring assembly 100 includes a pair of rails consisting of a cylinder rail 104 and a socket rail 102. The illustrated embodiment employs rails that are adapted for vertical shoring applications, and is commonly known in the art as a "vertical shore." Alternatively, the rails may be adapted for horizontal shoring applications, in which case the rails are referred to in the art as walers.

Figure 10:
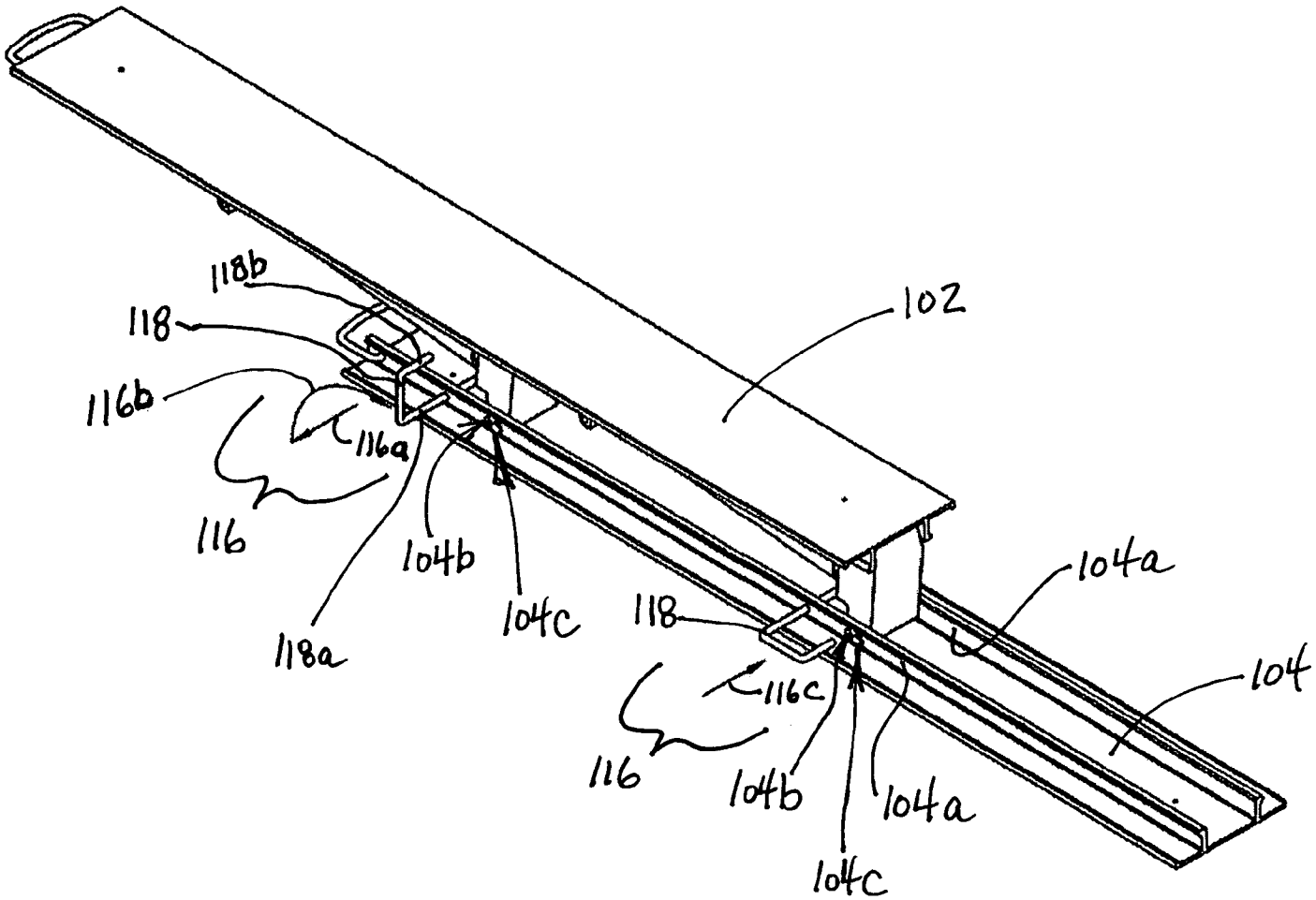
FIG. 10 is a perspective view of the shoring system of FIG. 4, shown in the fully folded position with a latch assembly being activated to restrict movement of the rails of the shoring system from the fully folded position.

A pair of first pads 106, called cylinder pads, each has an end 108 pivotally connected to the cylinder rail 104 for pivotal movement between open (or unfolded) and closed (or folded) positions. The open, unfolded position is shown in FIG. 4, while the closed, folded position is shown in FIG. 10 (described below).

Figure 7A:
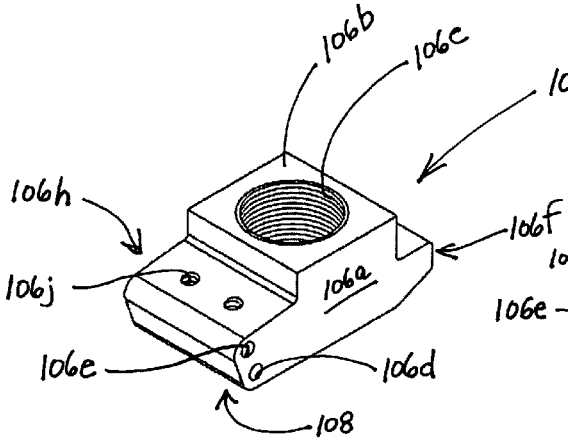
FIG. 7A is a perspective view of a cylinder pad in accordance with the present invention.
Figure 7B:
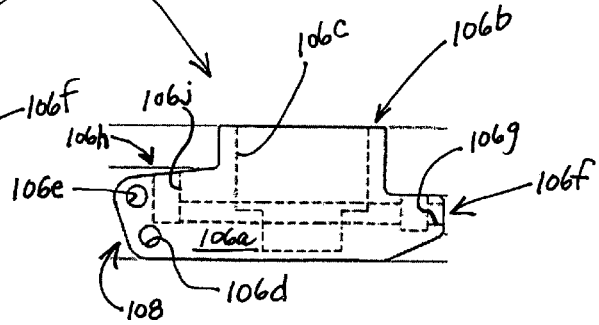
FIG. 7B is a side view of the cylinder pad of FIG. 7A.

FIGS. 7A–B illustrate a particular embodiment of the cylinder pad 106 in detail. The pad 106 includes a body 106*a* equipped with an upper face 106*b* having a threaded cylinder port 106*c* therein for engaging and selectively energizing one of the hydraulic jacks 114. The body 106*a* is further equipped with a first transverse bore 106*d* therein for pivotal connection to the flanges of the cylinder rail 104, and a second transverse bore 106*e* therein for latching the body 106*a* to the flanges of the cylinder rail 104 so as to restrict pivoting of the body 106*a* relative to the cylinder rail 104.

The cylinder pad body 106*a* is further equipped with a first flange 106*f* having a pair of fluid entry ports 106*g* therein, and a second flange 106*h* having a pair of fluid exit ports 106*j* therein. The fluid entry ports 106*g* extend through a side wall of the first flange 106*f* (see FIG. 7B) of the pad body 106*a* and are oriented perpendicularly to the cylinder port 106*c*. The fluid exit ports 106*j* extend through an upper wall of the second flange 106*h* of the pad body 106*a* and are substantially parallel to the cylinder port 106*c*. The cylinder port 106*c* is configured so as to be in fluid communication with the fluid entry ports 106*g* and fluid exit ports 106*j*.

The second flange 106*h* of each cylinder pad body 106*a* has a beveled side wall, defining the pivotally-connected end 108 (see FIG. 7B in particular) to restrict pivoting of the cylinder pads 106 when the rails 102, 104 are folded to the closed position. With reference to FIG. 5C, this results in a slight elevation of the hydraulic jacks 114 above the cylinder rail 104, such that each hydraulic jack 114 is oriented at an acute angle a with respect to the rails 102, 104 when the shoring assembly 100 is fully folded (and configured as shown in FIG. 5C). This tends to eliminate or reduce a pinching hazard that otherwise exists due to the ability (within prior art shoring systems) of the hydraulic jacks to pivot into contact with the cylinder rail 104.

Figure 5A:
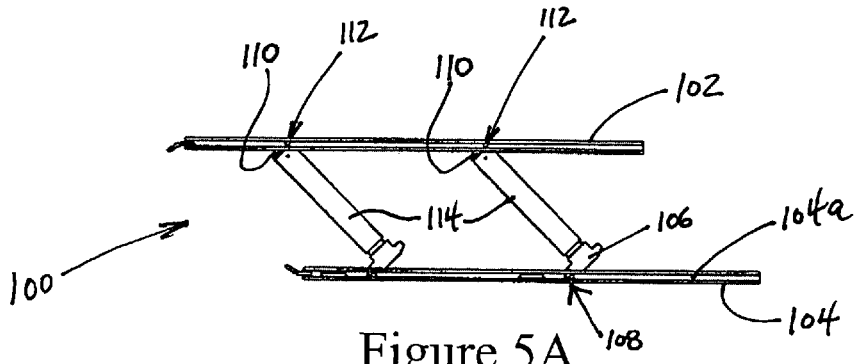
FIGS. 5A–5C are sequential side views of the shoring system of FIG. 4 as it is moved between partially folded and fully folded positions.
Figure 5B:
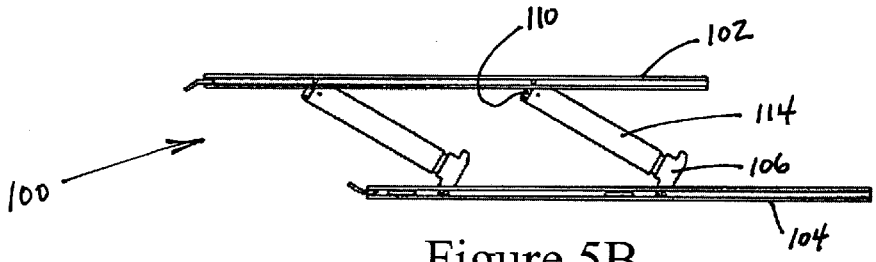
Figure 5C:
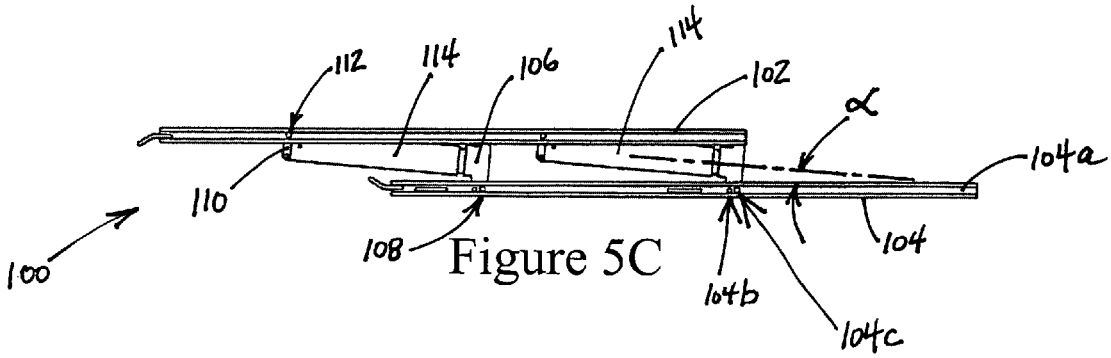

With reference to FIGS. 5A–5C, a pair of second pads 110, called socket pads, each has an end 112 pivotally connected to the socket rail 102 for pivotal movement between the open, unfolded and closed, folded positions. Those skilled in the art will appreciate that the socket pads 110 are similar to socket pads 26 of a typical shoring system, while the cylinder pads 106 are distinct and represent another aspect of the present invention.

Figure 9:
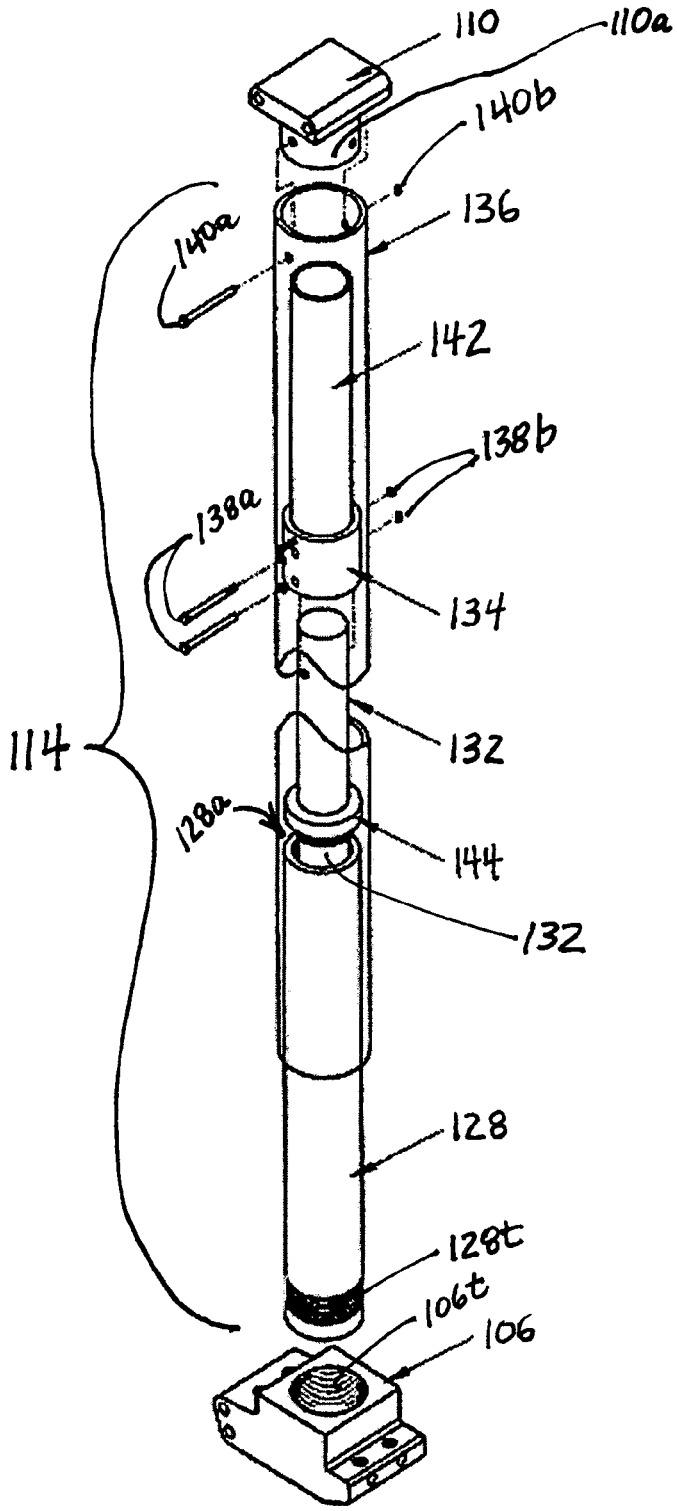
FIG. 9 is an exploded view of a hydraulic jack containing the wiper guide and hydraulic cylinder of FIG. 8, in accordance with the present invention.

A pair of hydraulic jacks 114 separate the rails 102, 104, and are each operatively connected between an opposing pair of the cylinder and socket pads 106, 110. With reference now to FIG. 9, each of the hydraulic jacks 114 preferably includes a hydraulic cylinder 128, a hydraulic piston (not shown) disposed for axial movement within the hydraulic cylinder 128, and a piston rod 132 for transferring force to or from the hydraulic piston. Accordingly, each of the cylinder pads 106 is adapted for operative connection to the hydraulic cylinder 128 of one of the hydraulic jacks 114, such as by the engagement of complementing threaded portions 128*t* and 106*t* thereof.

Each of the socket pads 110 is adapted for operative connection to the hydraulic piston rod 132 of one of the hydraulic jacks 114. In the embodiment of FIG. 9, this operative connection is achieved through an extension plug 134 which connects the piston rod 132 to an extension oversleeve 136 by way of bolts 138*a* secured in complementing bores (not numbered) in the piston rod 132, extension plug 134, and extension oversleeve 136 by nuts 138*b*. The extension oversleeve 136 is secured to the socket pad 110 by a bolt 140*a* secured in complementing bores (not numbered) in the extension oversleeve 136 and socket pad base cylinder 110*a* by a nut 140*b*. An extension inner sleeve 142 is also connected to the extension plug 134, and extends through the extension oversleeve 136 for reinforcement thereof.

Figure 8:
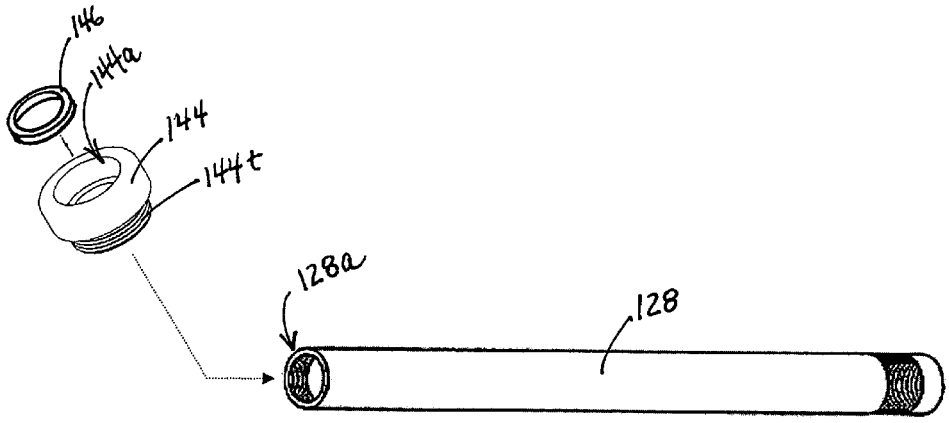
FIG. 8 illustrates a wiper guide and hydraulic cylinder in accordance with a particular aspect of the present invention.

With reference to FIGS. 8 and 9, in a particular embodiment of the shoring assembly, the hydraulic jack 114 further includes a wiper guide 144 adapted to fit an open end 128*a* of the hydraulic cylinder 128. The wiper guide 144 and the open cylinder end 128*a* are equipped with complementing threaded portions 144*t* and 128*t* for threaded interconnection. The wiper guide 144 has a central bore 144*a* therein for receiving the piston rod 132 and permitting sealed slidable movement of the piston rod therethrough. The wiper guide 144 further includes, as an optional feature, a bushing 146 adapted to fit the central bore 144*a* of the wiper guide so as to receive alternative piston rods having smaller diameters.

Figure 1:
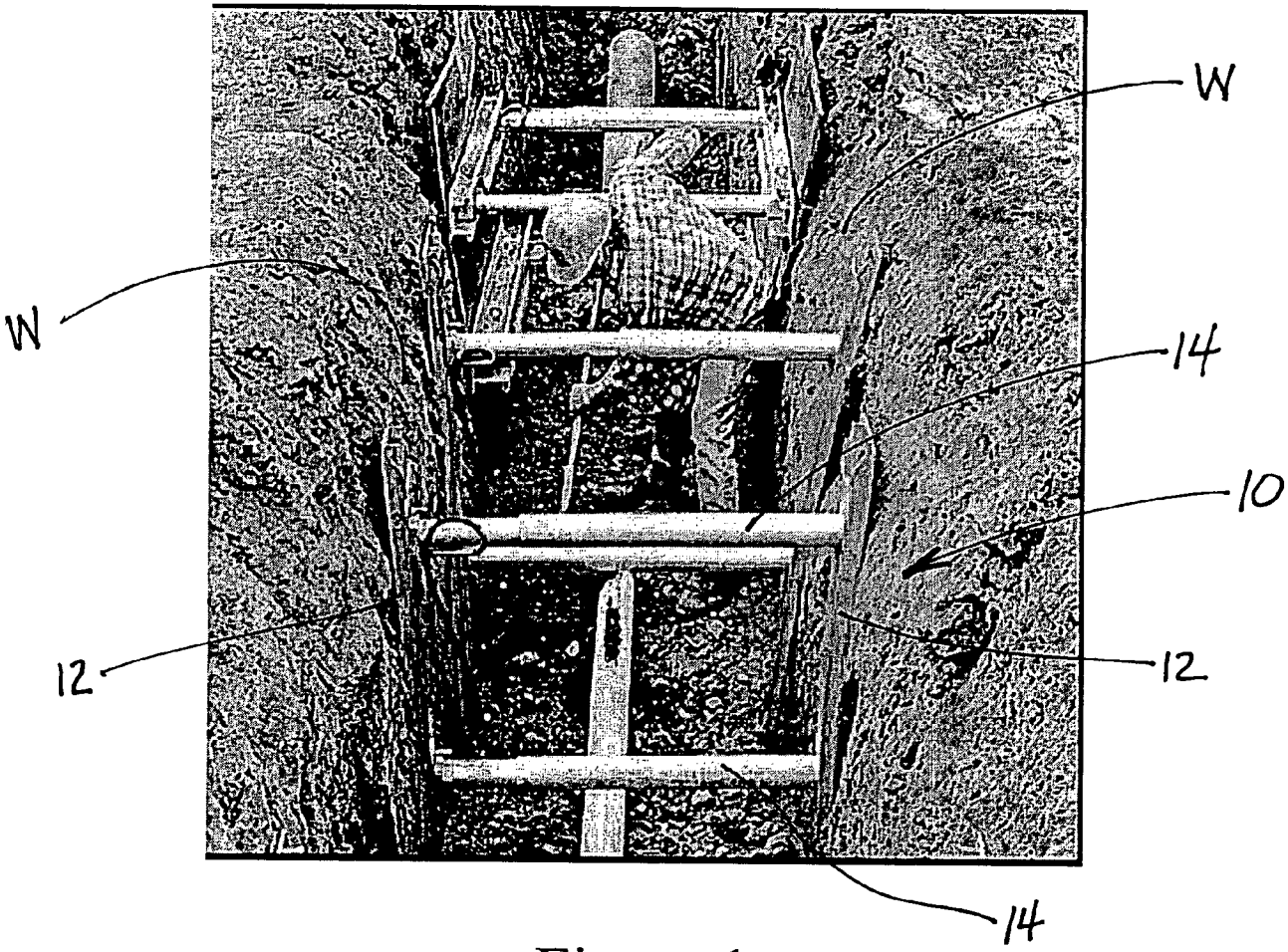
Figure 1 (Prior Art)
FIG. 1 depicts a plurality of prior art vertical shoring systems used in parallel to support the walls of an excavation.
Figure 2B:
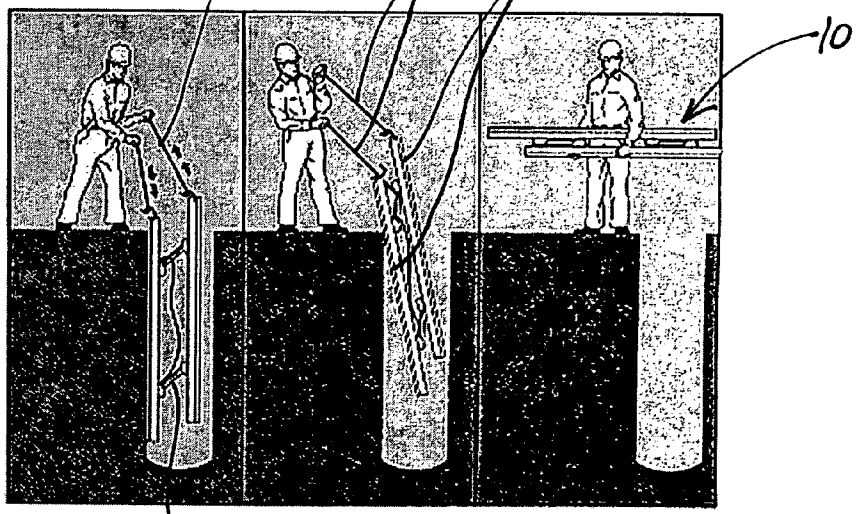
Figure 2B (Prior Art)
FIG. 2B shows the sequence for removing a typical vertical shoring system from an excavation.
Figure 2A:
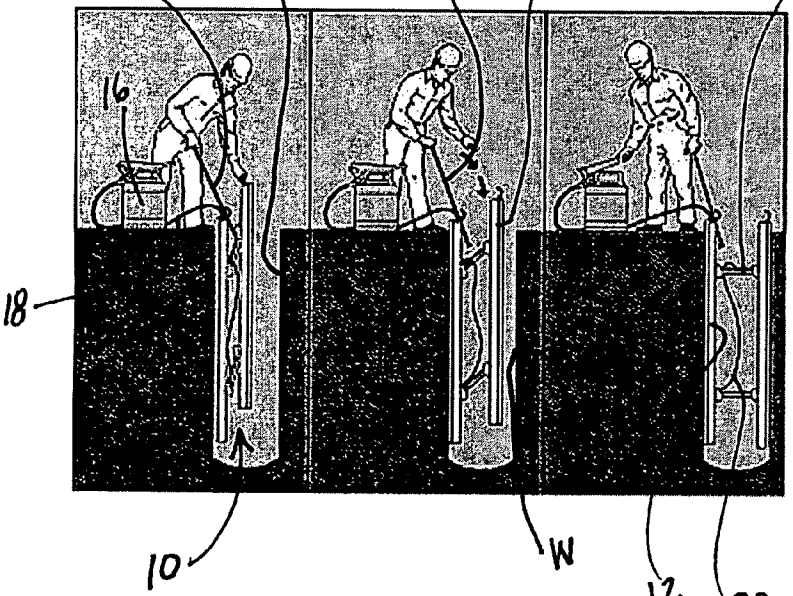
Figure 2A (Prior Art)
FIG. 2A shows the sequence for placing a typical vertical shoring system in an excavation.
Figure 3:
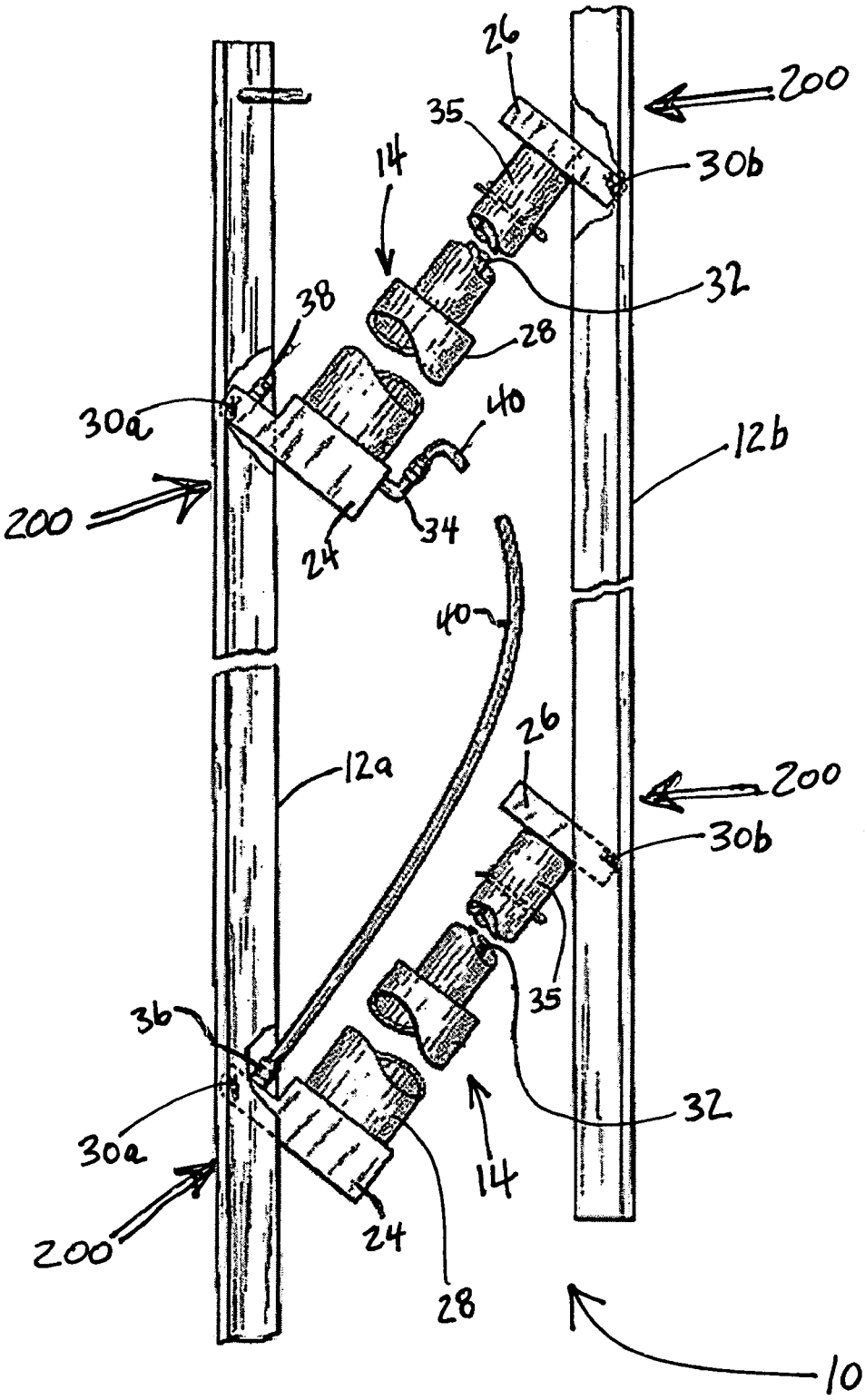
Figure 3 (Prior Art)
FIG. 3 is a detailed illustration of a typical vertical shoring system.

The cylinder and socket pads 106, 110 permit folding movement of the rails 102, 104 between the open, unfolded position (see FIG. 4)—wherein the hydraulic jacks 114 are substantially perpendicular to the rails—and the closed, folded position (see FIG. 10) wherein the hydraulic jacks are oriented at one or more acute angles with respect to the rails. FIGS. 5A–5C and 6A–6C depict the sequence of movement by the rails and the jacks between these two positions. It will be appreciated by those skilled in the art that such sequential movement is similar to the movement illustrated in FIGS. 2A–B for typical shoring systems.

Figure 6A:
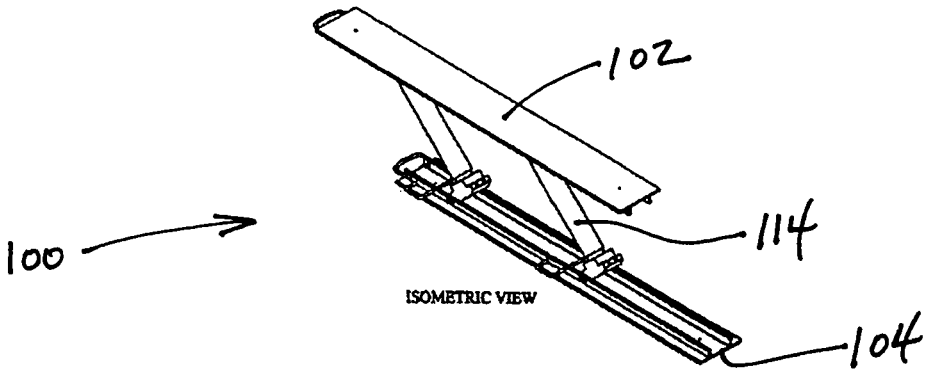
FIGS. 6A–6C are perspective views of the shoring system of FIG. 4 as it is moved between partially folded and fully folded positions.
Figure 6B:
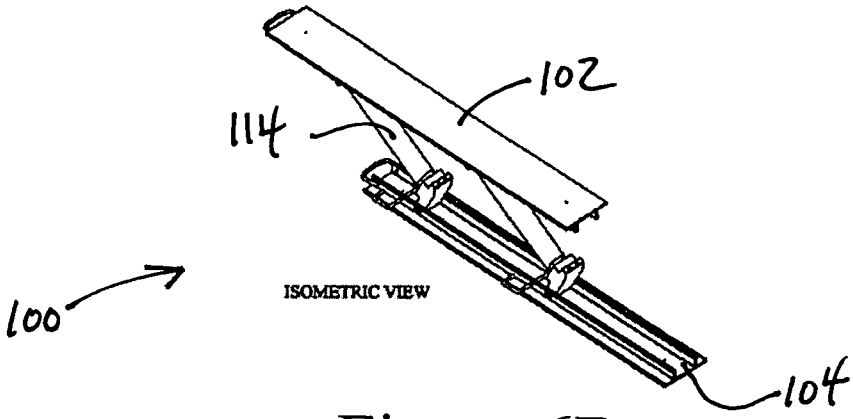
Figure 6C:
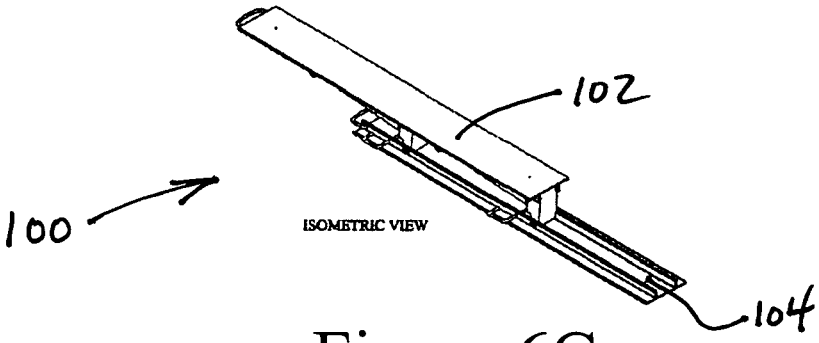

The shoring assembly 100 further includes a latch assembly 116 for restricting movement by the rails 102, 104 from the closed position of FIG. 10 (as well as FIGS. 5C, 6C). Thus, in a particular embodiment of the inventive shoring assembly, the cylinder rail 104 includes a pair of first locking bores 104*b* through at least one of the flanges 104*a* thereof. The cylinder pads 106 are each pivotally connected to the cylinder rail at pivoting bores 104*c* adjacent the respective first locking bores 104*b*, by way of the transverse bore 106*e* which defines a second locking bore that is alignable with one of the respective first locking bore 104*bs* when the first pads are pivoted to positions at or near the closed positions (see FIGS. 5C, 6C, and 10). Accordingly, the latch assembly 116 includes a pair of locking pins 118 each sized and shaped for insertion into the first and second bores 104*b*, 106*e* when the bores are aligned.

As illustrated in FIG. 10, the locking pins 118 are releasably carried by the cylinder rail 104. More particularly, the cylinder rail 104 preferably includes a plurality of carrying bores (not numbered) through the flanges 104*a* thereof, and each of the locking pins 118 includes a rod-like member having two ninety-degree bends therein defining parallel elongated and shortened linear portions 118*a*, 118*b*. The elongated linear portion 118*a* of the rod-like member is rotatably-carried in the carrying bores of the flanges 104*a* for selectively aligning—by pulling out (see 116*a* in FIG. 10) and rotating (see 116*b*) the locking pin 118, and inserting (see 116*c* in FIG. 10) the shortened linear portion 118*b* into the aligned first and second bores 104*b*, 106*e* of the flanges 104*a* and cylinder pads 106, respectively.

Thus, one aspect of the present invention may be summarized as a method of restricting movement from a collapsed or folded position of a pair of rails 102, 104 employed by a shoring assembly 100. The method includes the step of restricting pivoting of the employed cylinder pads 106 relative to the employed cylinder rail 104 when the rails 102, 104 are disposed in the folded or collapsed position. While the illustrated embodiment of the restricting step employs a locking pin releasably carried by the cylinder rail 104, it will be recognized by those skilled in that art that other means for restricting such movement, such as straps, clamps, etc., may be employed to advantage without departing from the spirit of the present invention.

It will be understood from the foregoing description that various modifications and changes may be made in the preferred and alternative embodiments of the present invention without departing from its true spirit. For example, although the illustrated embodiments are limited to vertical shoring assemblies (i.e., vertical shores), the present invention is adaptable for use with horizontal shoring assemblies, as well as other shoring application.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

What is claimed is:

1. A shoring assembly, comprising:

a pair of rails;

a plurality of first pads each having an end pivotally connected to one of the rails for pivotal movement between open and closed positions;

a plurality of second pads each having an end pivotally connected to the other of the rails for pivotal movement between open and closed positions;

a plurality of hydraulic jacks each being operatively connected between an opposing pair of first and second pads;

the first and second pads permitting folding movement of the rails between an open position wherein the hydraulic jacks are substantially perpendicular to the rails and a closed position wherein the hydraulic jacks are oriented at one or more acute angles with respect to the rails; and a latch assembly for restricting movement by the rails from the closed position.

2. The shoring assembly of claim 1, wherein the rails are adapted for vertical shoring applications.

3. The shoring assembly of claim 1, wherein each of the hydraulic jacks comprises a hydraulic cylinder, a hydraulic piston disposed for axial movement within the hydraulic cylinder, and a piston rod for transferring force to or from the hydraulic piston.

4. The shoring assembly of claim 3, wherein:

each of the tint pads is adapted for operative connection to the hydraulic cylinder of one of the hydraulic jacks; and each of the second pads is adapted for operative connection to the hydraulic piston rod of the one hydraulic jack.

5. The shoring assembly of claim 1, wherein the pivotally-connected end of each of the first pads is beveled to restrict pivoting of the first pads when the rails are folded to the closed position.

6. The shoring assembly of claim 1, wherein:

the one rail includes a plurality of first locking bores through a portion thereof;

the first pads are pivotally connected to the one rail at positions adjacent the respective first locking bores, the first pads Including respective second locking bores that are alignable with the respective first locking bores when the first pads are pivoted to positions at or near the closed positions; and the latch assembly comprises a pair of locking pins each sized and shaped for insertion into the first and second bores when aligned.

7. The shoring assembly of claim 6, wherein the locking pins are releasably carried by the one rail.

8. The shoring assembly of claim 7, wherein:

the one rail includes a plurality of carrying bores through a flanged portion thereof; and each of the locking pins comprises a rod-like member having at least one ninety-degree bend therein defining parallel elongated and shortened linear portions, the elongated linear portion being rotatably-carried in the carrying bores for selectively aligning and inserting the shortened linear portion into the first and second bores when aligned.

9. The shoring assembly of claim 1, wherein the hydraulic jack further comprises:

a wiper guide adapted to fit an open end of the hydraulic cylinder, the wiper guide having a central bore therein for receiving the piston rod and permitting sealed slidable movement of the piston rod therethrough; and a bushing adapted to fit the central bore of the wiper guide so as to receive piston rods having smaller diameters.

10. A pad for use in a shoring assembly having a pair of rails each equipped with a pair of parallel flanges, the pad comprising a body equipped with:

an upper face having a cylinder port therein for selectively energizing a hydraulic jack employed by the shoring assembly;

a first transverse bore therein for pivotal connection to the flanges of one of the rails of the shoring assembly; and a second transverse bore therein for latching the body to the flanges of the one rail so as to restrict pivoting of the body relative to the one rail;

a first flange having a pair of fluid entry ports therein, the fluid entry ports extending through a side wall of the first flange and being oriented perpendicularly to the cylinder port; and a second flange having a pair of fluid exit ports therein, the fluid exit ports extending through an upper wall of the second flange and being substantially parallel to the cylinder port;

the cylinder port being in fluid communication with the fluid entry ports and fluid exit ports.

11. The pad of claim 10, wherein the second flange of the body has a beveled side wall for restricting pivoting of the body relative to the one rail.

12. A method of restricting movement from a collapsed position of a pair of rails employed by a shoring assembly, the shoring assembly having a plurality of first pads each pivotally connected to one of the rails, a plurality of second pads each pivotally connected to the other of the rails, and a plurality of hydraulic jacks each being operatively connected between an opposing pair of first and second pads, the method comprising the step of:

restricting pivoting of the plurality of first pads relative to the one rail when the rails are disposed in the collapsed position.

13. The method of claim 12, wherein the restricting step comprises using a locking pin releasably carried by the one rail.

14. The method of claim 12, wherein the restricting step comprises using a latch assembly.

15. The method of claim 12, wherein the rails are adapted for a vertical shoring application.

16. The method of claim 12, wherein the rails are adapted for a horizontal shoring application.

17. The method of claim 12, wherein the restricting step comprises using a strap or a clamp.

18. The shoring assembly of claim 1, wherein the rails are adapted for a horizontal shoring application.

* * * * *